United States Patent [19]

Heppner

[11] 4,212,217

[45] Jul. 15, 1980

[54] WEB DISPENSER

[75] Inventor: John B. Heppner, Toronto, Canada

[73] Assignee: C. A. Pemberton & Co., Toronto, Canada

[21] Appl. No.: 943,522

[22] Filed: Sep. 18, 1978

[30] Foreign Application Priority Data

Nov. 14, 1977 [CA] Canada ..... 290705

[51] Int. Cl.[2] ..... B26D 5/20

[52] U.S. Cl. ..... 83/277

[58] Field of Search ..... 83/278, 423, 276, 277

[56] References Cited

U.S. PATENT DOCUMENTS

| | | | |
|---|---|---|---|
| 1,060,291 | 4/1913 | Small | 83/278 |
| 1,211,543 | 1/1917 | Chatfield | 83/278 |
| 2,061,524 | 11/1936 | Storck | 83/278 |
| 2,872,007 | 2/1959 | Robb et al. | 83/278 |
| 3,280,678 | 10/1966 | Shackelford | 83/278 X |
| 3,440,911 | 4/1969 | Miller | 83/278 |

*Primary Examiner*—Harold D. Whitehead

*Attorney, Agent, or Firm*—Fetherstonhauge & Co.

[57] ABSTRACT

This invention relates to a dispenser for dispensing a flexible web from a roll of web material such as plastic, paper or the like. The dispenser has a feeder mechanism which engages a portion of the unwinding web and moves longitudinally through the bite of a cutter mechanism so as to provide a manually engageable portion of web downstream from the cutter mechanism. The mechanism has the advantage that it enables the web to be dispensed without the operator being required to reach through the bite of the cutter mechanism. The dispenser includes a housing having an unwinding support for supporting a roll of web material in a position to permit unwinding thereof. A cutter mechanism is mounted on the housing and is spaced outwardly from the unwinding support. A web feeder mechanism is carried by the housing and is adapted to reciprocate in the longitudinal direction of the path in which the web is to be fed. The web feeder mechanism includes a web engaging member which engages and drives the web along an unwinding path to cause a portion of the web to project outwardly from the cutter so as to be manually engageable.

6 Claims, 7 Drawing Figures

WEB DISPENSER

FIELD OF INVENTION

This invention relates to a dispenser for dispensing a flexible web from a roll of web material.

PRIOR ART

Numerous devices have been used for cutting a length of web material such as a sheet of plastic from a continuous roll of plastic material. Hot wire cutting devices have been used for cutting webs of plastic material for some time. However, the melted plastic tends to build up on the hot wire and reduces the efficiency of the cutting operation. Mechanisms which employ cutter blades are hazardous to use because of the danger of activating the cutting mechanism when manually manipulating the web through the bit of the cutter blades.

To overcome the difficulty of feeding the web material through the bit of the blade, I provide a feeder mechanism which engages a portion of the unwinding web and it moves it longitudinally through the bite of the cutter mechanism so as to provide a manually engageable portion of the web downstream from the cutter mechanism. This mechanism has the advantage that it enables the web to be dispensed without the operator being required to reach through the bite of the cutter mechanism.

Although various mechanisms may be provided for feeding the web through the bite of the cutter mechanism, I have found that a simple and inexpensive mechanism may be provided by employing a pusher unit which drives a pair of fingers through the body of the web and thereafter moves the fingers longitudinally to push the web through the bit of the cutter mechanism and thereafter withdraws the fingers and returns the fingers to their original starting position.

In order to permit the apparatus to be operated without the need to reach through the bite of the cutter blade to activate the dispensing mechanism, I prefer to provide an actuator bar at the front end of the housing which supports the dispenser mechanism whereby the dispensing web may be draped over the bar and pressure applied to the bar by the dispensing web to move the bar to and fro between a position in which the various drive mechanisms are deactivated and activated as required.

SUMMARY OF INVENTION

According to one aspect of the present invention, there is provided a dispenser for dispensing a flexible web from a roll of web material comprising a housing, unwinding support means on the housing for supporting a roll of web material in a position to permit unwinding thereof, cutter means on said housing spaced outwardly from said unwinding means, said cutter means being adapted to cut said web into lengths, a dispenser path extending longitudinally from said unwinding means to said cutter means, guide plate means disposed above and below said dispenser path for supporting and guiding an unwinding web along said dispenser path, passage means opening through one of said guide plates into said dispenser path and extending longitudinally thereof, web feeder means carried by said housing and adapted to reciprocate in the longitudinal direction of said path, said web feeder means including web engaging means for projecting through said passage means to engage and drive a web along said path to cause a portion of the web to project outwardly from the cutter means so as to be manually engageable.

According to a further aspect of the present invention there is provided in a dispenser having a housing, a platform and a guide plate carried by said housing, said guide plate being disposed above the platform and spaced therefrom to form a guideway therebetween through which an unwinding web is dispensed, a web feeder means comprising guide rail means mounted below said platform, a pusher plate having a front end and a back end, said pusher plate having a fulcrum portion at the back end thereof about which it is adapted to rock so as to raise and lower the front end thereof with respect to said platform, finger means mounted on the front end of said pusher plate for movement into and out of said guideway in response to raising and lowering of said front end of said platform and feeder drive means comprising an extensible ram mounted within said housing and hingedly connected to said housing and said pusher plate and adapted to extend and contract in a direction which is inclined towards the plane of the platform in a direction from back to front of the housing so as to rock the pusher plate to the position elevating the fingers and to drive the pusher plate along the platform in response to extension of said ram and to lower and withdraw the fingers from the guideway and move the pusher plate towards the back end of the housing in response to contraction of the ram.

According to yet another aspect of the present invention there is provided in a dispenser mechanism having a dispenser housing, an actuator mechanism for activating and deactivating a feeder and cutter mechanisms, comprising, switching means movable between off and on positions for respectively deactivating and activating said cutter drive means and feeder drive means, an actuator bar pivotably mounted on said dispenser housing for movement between a first position permitting said switch means to assume its off position and a second position in which it locates said switch means in its on position, said actuator bar being located at the front end of said housing and extending transversely thereof whereby a dispensing web may be draped over said bar and the bar may be moved by pressure applied to it by way of the web to move the bar from said first position to said second position to initiate a cutting and feeding action.

The invention will be more clearly understood after reference to the following detailed specification read in conjunction with the drawings, wherein.

Figure 1:
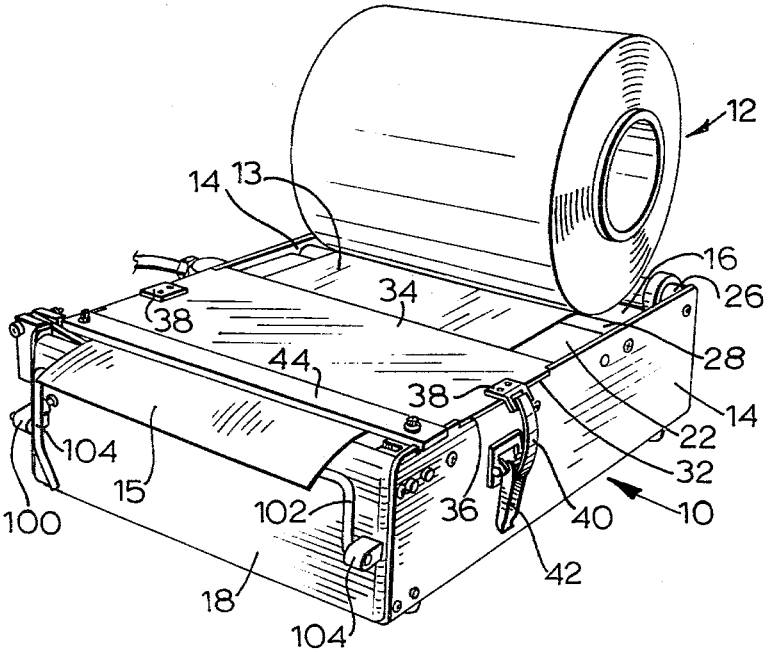
FIG. 1 is a pictorial front view of a dispenser according to an embodiment of the present invention.

With reference to the drawings, the reference numeral 10 refers generally to a web dispenser housing for use in dispensing a web from a roll 12 of flexible web material such as plastic, paper or the like. The housing 10 consists of a pair of oppositely disposed side walls 14, a back wall 16 and a front wall 18. The housing also has a bottom wall 20 (FIG. 2) and a top wall, hereinafter referred to as the platform 22. The walls of the housing enclose a chamber 24. The roll 12 of web material which is to be dispensed is supported by unwinding support rollers 26 and 28 which extend transversely between the oppositely disposed side walls 14 and are located towards the back end of the housing.

The platform 22 extends forwardly from adjacent the unwinding support roller 28 to adjacent the front end of the housing. A pair of spacer plates 30 extend longitudinally of the platform at opposite side edges thereof, the upper edge of each of the side walls 14 is notched at 32 and a guide plate 34 extends transversely between side walls 14 and is spaced above the platform 22 by spacer plates 30. The guide plate 34 has a short lug portion 36 at each end thereof which extends into the notches 32 formed in side walls 14 so as to restrain the guide plate against longitudinal movement. Latch plates 38 are located at opposite ends of the guide plate 34 and are adapted to be releasably engaged by quick release latches 40. The latches 40 serve to retain the guide plate 34 against lifting away from the platform 22. The latches 40 have a quick release lever 42 which may be raised from the position shown in FIG. 1 to release the latch arm from the latch plate 38.

The cutter mechanism comprises a stationary cutter bar 44 which extends transversely of the front end of the housing and is spaced above the platform 22. The guide plate 34 and stationary cutter bar 44 are spaced above the platform 22 a distance sufficient to enable the unwinding web to extend through the passage formed therebetween along a dispenser path extending from the unwinding mechanism to and through the cutter mechanism.

Figure 2:
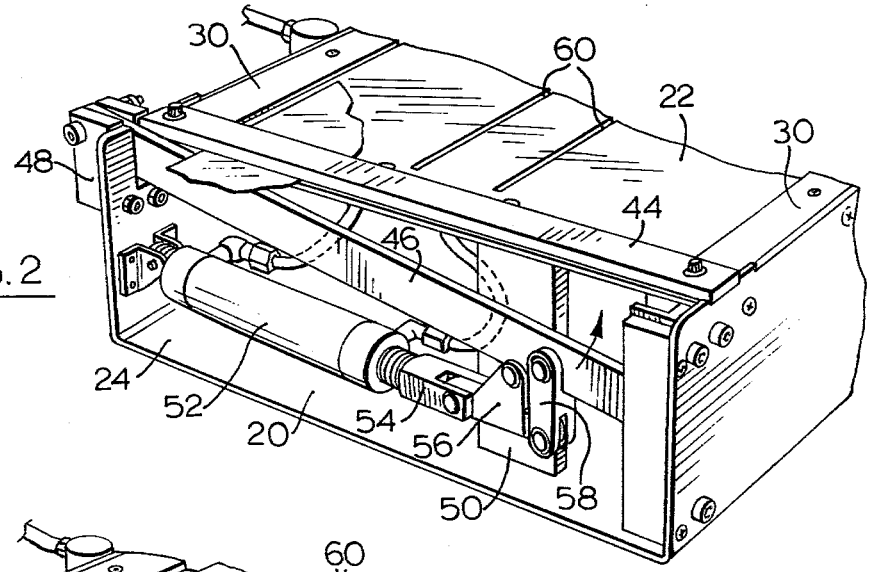
FIG. 2 is a partial front view with a front plate of the housing removed to show the cutter mechanism in the deactivated position.
Figure 3:
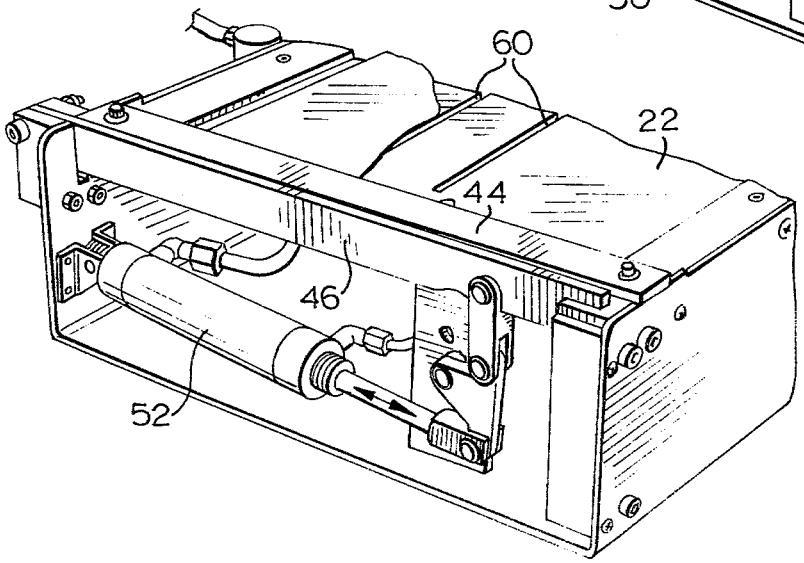
FIG. 3 is a view similar to FIG. 2 showing the cutter mechanism in the activated position.

As shown in FIG. 2 of the drawings, a movable cutter bar 46 has one end pivotally mounted in a support bracket 48 which projects outwardly from one of the side walls 14 of the housing. A support post 50 is secured with respect to the bottom wall 20 and platform 22 and extends vertically therebetween. The drive mechanism for driving the moving blade 46 between the lowered position and raised position shown in FIGS. 2 and 3 of the drawings includes a pneumatic cylinder 52 which has a piston rod 54 adapted to be reciprocally driven thereby. The piston rod is connected at its outer end to a rocker arm 56 which is pivotally mounted on the support post 50. A link arm 58 has one end connected to an end of the rocker arm 50 and its opposite end pivotally connected to the moving cutter blade 46. In use, when air is supplied to extend the piston 54, the cutter blade 46 is raised by the action of the rocker arm 56 and link 58 from the position shown in FIG. 2 to the position shown in FIG. 3 to cooperate with the stationary bar 44 to cut any web extending therebetween. When air is vented from the cylinder 52, the piston rod 54 is retracted and the movable cutter blade 46 is again lowered to the position shown in FIG. 2.

As shown in FIG. 1 of the drawings, the roll of web 12 is supported on unwinding rollers 26 and 28 as previously described and a portion 13 of the web extends forwardly across the platform 22 to the cutter mechanism and a portion 15 which extends outwardly beyond the cutter mechanism. After the portion 15 is cut from the portion 13 by the operation of the cutting mechanism as described above, it is important to provide a mechanism for automatically feeding the web through the cutting station so that it is not necessary for the operator to manually manipulate the web between the blades of the cutter mechanism. This objective is achieved by the feeder mechanism described hereinafter. The feeder mechanism operates by extending fingers through passages 60 which extend longitudinally of the platform 22 and communicate between the chamber 24 and the passageway fromed between the platform 22 and the guide plate 34. The guide plate 34 is formed with coextensive slots 62 in the lower face thereof.

The feeder mechanism includes a double-acting pneumatic cylinder 70 which has a flow regulator 72 in air line 74. A second air line 76 is connected to the other end of the cylinder 70. The cylinder 70 is pivotally connected at its lower end by means of a pair of brackets 78 to the bottom wall 20 of the housing. An extensible drive shaft 80 extends outwardly from the other end of the cylinder and is pivotably connected to a bracket 82 which is rigidly secured to the lower face of a pusher plate 84. The back end of the pusher plate 84 is curved away from the platform 22 to form a fulcrum edge 86 about which the pressure plate 84 may rock from the lowered position shown in FIG. 5 to the raised position shown in FIG. 6 as will be described hereinafter. A pair of needle-like fingers 88 are located adjacent the front end of the pusher plate 84 and project upwardly therefrom. The fingers 88 have a length sufficient to extend through the passages 60 in the platform, and through the dispenser passage formed between the platform and the guide plate and into the slots 62 formed in the guide plate when the pusher plate 84 is in the raised position shown in FIG. 6.

A pair of guide rails 90 are located on the underside of the platform 22 and extend longitudinally thereof on opposite sides of the passages 60. The guide rails 90 have guide channels 92 extending longitudinally thereof. The side edges of the pusher plate 82 extend into the channels 92 of the guide rails. The channels 92 have a height which is substantially greater than the thickness of the pusher plate 84 so as to permit the pusher plate to move between the lowered position shown in FIG. 5 and the raised position shown in FIG. 6 of the drawings. A spring clip 94 is mounted on the underside of the platform 22 and has a pair of arms 96 projecting forwardly therefrom. The arms 96 each have a raised nose portion 98 adjacent the outer end thereof.

Figure 5:
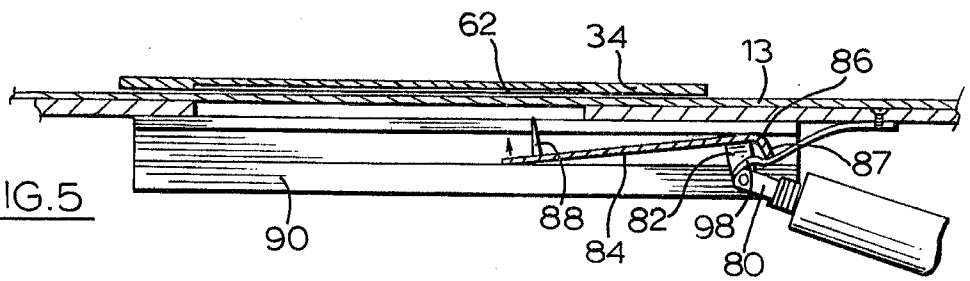
FIGS. 5 and 6 are side views of the feeder mechanism in first and second positions.
Figure 6:
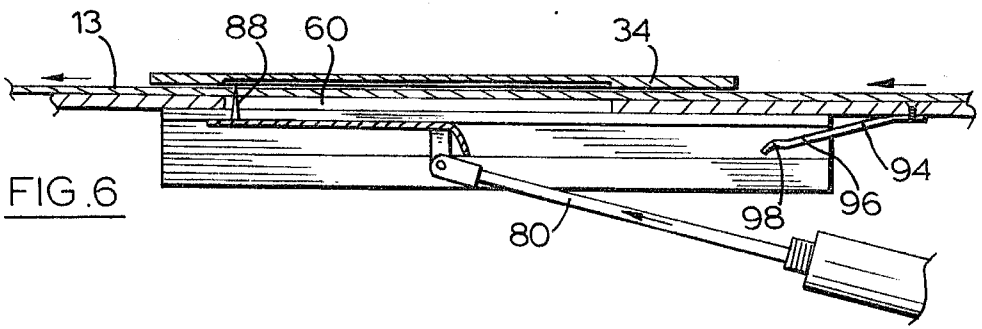
Figure 4:
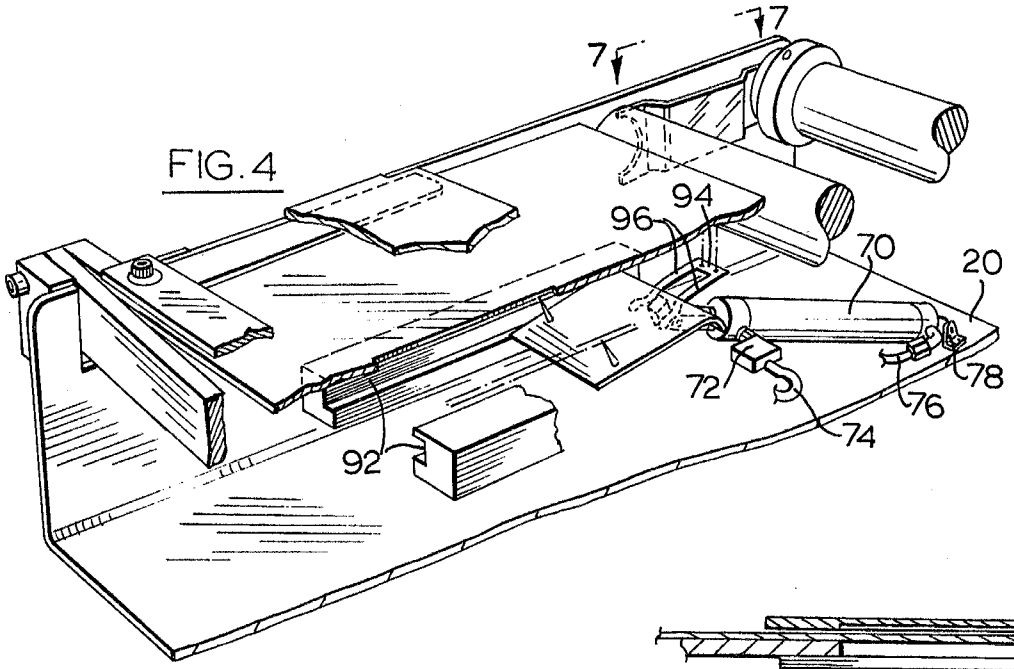
FIG. 4 is a partial longitudinal sectional view through the housing showing the feeder mechanism in a first position.

In use, when the pneumatic cylinder 74 is retracted, the lip portion 87 at the back edge of the pusher plate 84 is drawn over the nose 98 of the spring clip to the position shown in FIG. 5 of the drawings. The pressure applied by the spring clip serves to maintain the front edge of the pressure plate in the lowered position so that the needles 88 are fully withdrawn from the dispenser passage. When the pneumatic cylinder 74 is extended, the initial forward movement of the rod 80 will cause the pressure plate 84 to rock about fulcum point 86, thus driving the needles 88 upwardly through the web 13 into the channels 62 of the guide plate 34. The guide plate 34 serves to prevent the web 13 from merely lifting upwardly away from the platform as the needles 88 are driven through the dispenser passage. The nose portion 98 of the spring clip 94 serves to prevent the pusher plate merely moving forwardly in the lowered position. The fact that the connection between the piston rod 80 and bracket 82 of the pusher plate is spaced outwardly from the fulcum point 86 and the fact that the piston rod 80 extends in a plane which is angularly inclined with respect to the plant of the platform, the action of extending the piston rod from the position shown in FIG. 5 serves to cause the pressure plate to rock about the fulcum point 86 to drive the needles 88 upwardly through the body of the web located in the dispenser passage. Further extension of the rod 80 to the position shown in FIG. 6 advances the web 13 along the platform through the cutting station.

The flow control valve 74 in the circuit of the cylinder 70 serves to delay the operation of the feeding mechanism until the operation of the cutting mechanism has been completed so that the sequence of events is that the cutting mechanism is actuated to cut through the web and thereafter the web feeder mechanism is activated to advance the web to move a portion of the web yhrough the reopened cutter mechanism.

The mechanism for activating the cutting mechanism and feeding mechanism includes a switch 100 mounted on the front wall 18 and an actuator bar 102. The actuator bar 102 has one end thereof pivotably mounted in a support 104. The actuator bar 102 extends transversely across the front wall 18 and is disposed below the bit of the cutter blades so that the dispensing web portion 15 extends over a portion of the bar 102. The bar 102 also has a portion 104 adapted to engage and activate the switch 100. The actuator bar 102 is biased to a position in which the activating switch 100 is deactivated and is movable to a position activating the switch 100 by draping the portion 15 of the web downwardly over the bar so that the bar is rocked towards the front wall 18. Thus, the entire dispenser mechanism can be activated to cut the web and to feed an additional portion of the web by pulling downwardly on the leading portion 15 of the web. It will be understood that if a portion of web longer than manually engageable portion 15 is required, it is merely necessary to apply a forwardly directed pull to the manually engaging portion 15 which will cause the web to unwind from the coil 12.

Figure 7:
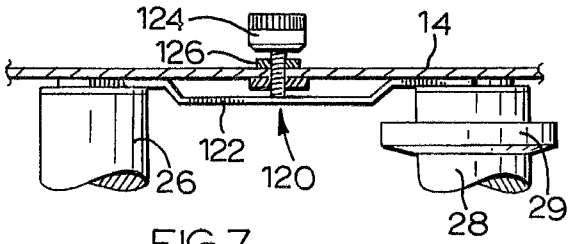
FIG. 7 is a sectional view in the direction of the arrow 7—7 of FIG. 4.

To prevent overrunning of the unwinding coil, a brake mechanism 120 (FIG. 7) is provided. The brake mechanism comprises a brake plate 122 which has a pair of fork-shaped ends adapted to extend over the ends of each shaft 26 and 28. A thumbscrew 124 is threaded through a nut 126 mounted in the sidewall 14. The end of the thumbscrew 124 bears against the plate 122 and may be used to drive the plate 122 against the ends of the shafts 26 and 28 to apply a friction load thereto to limit the rotation of the shafts 26 and 28 during unwinding of the roll.

In order to position the roll 12 on the shaft 28, a pair of collars 29 are mounted on the shaft 28 at opposite ends thereof. The collars 29 are longitudinally adjustable with respect to the shaft 28 so as to vary the width therebetween in accordance with the width of the web to be dispensed by the dispenser.

From the foregoing it will be apparent that the present invention provides a simple and inexpensive mechanism for dispensing a web of material such as plastic, metal foil, paper or the like.

Various modifications of the apparatus described in the preferred embodiment are possible without departing from the scope of the invention.

For example, it is possible to use the pusher mechanism of the present invention in association with a cutter mechanism other than the knife mechanism described in the preferred embodiment. In fact, the pusher mechanism may in some instances be used to advantage in combination with the cutter mechanism in the form of a hot wire. Similarly, it is possible to use the pusher mechanism with an actuator mechanism other than that described in the preferred embodiment. It is also possible to use the cutter mechanisms and actuator mechanisms independently of one another and independently of the feeder mechanism to advantage in certain application.

I claim:

1. A dispenser for dispensing a flexible web from a roll of web material, comprising;

(a) a housing having an inner chamber, an upper wall of said chamber forming a platform disposed above said inner chamber, said platform having a front end and a back end, (b) unwinding support means on said housing at said back end of said platform for supporting a roll of web material in a position to permit unwinding thereof in the direction of its longitudinal extent along said platform, (c) cutter means on said housing at said front end of said platform, said cutter means being adapted to cut the web transversely of its longitudinal extent to any required length, (d) a guide plate releasably mounted above said platform in a spaced relationship therewith to provide a narrow guideway therebetween for receiving the web and limiting the extent to which it can be raised above said platform, (e) passage means extending longitudinally of said platform and opening between said guideway and said inner chamber, (f) quick release means releasably retaining said guide plate with respect to said housing whereby said guide plate can be removed to facilitate feeding of said web along said guideway, (g) web feeder means mounted in said inner chamber and enclosed by said housing, said feeder means including finger means adapted to move into said guideway by way of said passage means to engage a web which is restrained by said guide plate as aforesaid and out of said guideway to release said web, (h) feeder drive means located in said inner chamber for driving said web feeder means into and out of said guideway and longitudinally of said platform to feed a web of material along said platform to project outwardly from said cutter means.

2. A dispenser as claimed in claim 1 wherein said web feeder means comprises;

(a) guide rail means mounted in said chamber below said platform, (b) a pusher plate slidably mounted in said guide rail, said pusher plate having a front end and a back end, said pusher plate having a fulcrum portion at the back end thereof about which it is adapted to rock so as to raise and lower the front end thereof with respect to said platform, (c) said finger means being mounted on the front end of said pusher plate for movement into and out of said guideway in response to raising and lowering of said front end of said platform, (d) said drive means comprising an extensible ram mounted within said housing and hingedly connected to said housing and said pusher plate and adapted to extend and contract in a direction which is inclined towards the plane of the platform in a direction from the back end thereof to the front end thereof so as to rock the pusher plate to the position elevating the fingers and to drive the pusher plate along the platform in response to extension of said ram and to lower and withdraw the fingers from the guideway and move the pusher plate towards the back end of the housing in response to contraction of the ram.

3. A dispenser as claimed in claim 1 wherein said cutter means comprises a guillotine having a stationary blade mounted on said housing above said platform and a moving blade pivotably mounted in said chamber below said platform for movement into and out of cutting engagement with said stationary blade, and cutter drive means in said inner chamber for driving said moving cutter blade into and out of cutting engagement with said stationary blade.

4. A dispenser as claimed in claim 3 including actuator means for activating said cutter drive means and said feeder drive means in sequence.

5. A dispenser as claimed in claim 4 wherein said actuator means includes switching means movable between off and on positions for respectively deactivating and activating said cutter drive means and feeder drive means, an actuator bar pivotably mounted on said housing for movement between a first position permitting said switch means to assume its off position and a second position in which it locates said switch means in its on position, said actuator bar being located at the front end of said housing and extending transversely thereof below the plane of said platform whereby a dispensing web may be draped downwardly from said front end of said platform over said bar to apply a pressure to said bar to move it from said first position to said second position to initiate a cutting and feeding action.

6. A dispenser as claimed in claim 1 wherein said unwinding means comprises;

a pair of unwinding rollers extending transversely of and mounted for rotation in said housing in a spaced parallel relationship to form a centreless support for supporting a roll of web material at its outer periphery for rotation thereon, and tension means for applying a drag tension to said rollers to prevent over-run of said web when unwinding.

* * * * *